US005855317A

United States Patent [19]

Dalrymple

[11] Patent Number: 5,855,317

[45] Date of Patent: Jan. 5, 1999

[54] CARTON TRAY AND METHOD OF FORMING SAME

[75] Inventor: Bruce H. Dalrymple, Loganville, Ga.

[73] Assignee: Malnove Holding Co., Inc., Omaha, Nebr.

[21] Appl. No.: 906,195

[22] Filed: Aug. 5, 1997

[51] Int. Cl.[6] ..... B65D 5/24

[52] U.S. Cl. ..... 229/186; 229/117.07; 493/128; 493/151

[58] Field of Search ..... 229/3.1, 117.07, 229/182, 186; 493/128, 130, 131, 132, 141–147, 150, 151

[56] References Cited

U.S. PATENT DOCUMENTS

| | | | |
|---|---|---|---|
| 1,886,879 | 11/1932 | Gross | 229/186 |
| 2,664,236 | 12/1953 | Levkoff | 229/186 |
| 3,545,665 | 12/1970 | Nimaroff | 229/186 |
| 3,734,391 | 5/1973 | Manizza | 229/117.07 |
| 5,297,726 | 3/1994 | Detzel | 229/186 |

FOREIGN PATENT DOCUMENTS

| | | | |
|---|---|---|---|
| 914213 | 10/1946 | France | 229/186 |

*Primary Examiner*—Gary E. Elkins
*Attorney, Agent, or Firm*—Zarley,McKee, Thomte Voorhees & Sease

[57] ABSTRACT

A carton tray has an improved corner construction including long and short overlapped connector tabs wherein the long connector tab is secured by adhesive both to the adjacent short connector tab and to the end panel to which the short connector tab is foldably connected. The result is a strong corner post of at least three-ply thickness and one which can be easily assembled on a standard hot melt forming machine with application of adhesive to only one side of the blank from which the carton tray is constructed. The invention is further directed to the method of forming the improved carton tray with the corner post construction described above.

21 Claims, 7 Drawing Sheets

CARTON TRAY AND METHOD OF FORMING SAME

BACKGROUND OF THE INVENTION

1. Technical Field

The present invention is directed generally to a carton tray with a new corner post construction and the method of forming the tray. Specifically, the invention is directed to an improved carton formed from blanks which may be shipped flat on pallets to a customer location where the cartons may be assembled on a customer's forming machine into strong, attractive cartons without exposed raw edges on the exterior corners.

2. Description of the Prior Art

Oftentimes, tray forming of folding cartons can be objectionable to users requiring a high degree of structural aesthetics and vertical stacking strength. Common glue-forming of trays employs four Britewood style corner posts bonded inside to either the side panels or end panels. When this type of carton is viewed at eye level, the resulting outside corner always shows a die-cut raw edge.

One way around this is full gusset style forming. A gusset no longer exhibits this raw edge but requires that the paper board be coated on both sides with a heat sealing medium or requires that the glue forming be fairly complicated and expensive. In both cases, the gusset must be bonded to itself and then bonded inside the carton body.

Gusset or bellows corners have been designed in the past so the bonding medium on only one side of the substrate can bond the gusset only to the side panel of the carton. This is difficult and doesn't allow for bonding the gusset to itself. The gusset bonding to the side panel is marginal at best.

Bellows have been designed in the past to provide a carton corner construction but through bonding to a flange and usually to the outside of the carton only. A secondary risky and difficult design is where one side of the gusset is cut down slightly.

Setup cartons have been prepared in the past which are strong and present no die-cut raw edges but these are extremely expensive because they are overwrapped with a printed glued-on paper and are shipped fully assembled and empty. Simplex trays have been designed which may be shipped flat and manually or machine assembled by folding a double thickness end panel over fully gusseted folding corners with locking tabs to hold the assembled corners together but gaps are often formed in the assembled corner and much paperboard is required or wasted for the double side panels and end panels required for a simplex tray.

Accordingly, there is a need for an improved carton construction and method of forming same which enables carton blanks to be shipped flat for simple assembly on a customer's forming machine with adhesive applied to only one side of the carton blank and with multi-ply strong corners which exhibit no die-cut raw edges.

Accordingly, a primary object of the invention is to provide an improved carton tray and method for forming same which enables formation on simple machinery yet which provides an aesthetically pleasing and strong corner construction.

Another object is to provide such a carton tray and method which makes efficient use of the paper board stock from which it is formed.

Another object is to provide such a carton tray and method of forming same which provides such an inherently strong corner construction that the caliper of the paperboard blank may be dropped without sacrificing stacking strength compared to higher caliper trays of known construction.

Another object is to provide such a carton tray and method of forming same which enable blanks to be shipped flat on pallets to a customer location where the cartons can be fully assembled on the customer's forming machine with application of adhesive to only one side of the cartons.

A related object is to provide such a carton tray and method of forming same which enables assembly on standard hot melt glue forming machines.

Finally, an object of the invention is to provide an improved carton tray which is simple and rugged in construction, economical to manufacture and efficient in operation.

SUMMARY OF THE INVENTION

The improved carton tray of the invention is formed from a blank having a generally rectangular bottom wall with opposite end panels and side panels foldably connected to the opposite ends and opposite side edges thereof, with each end panel having short connector tabs foldably connected to the ends thereof and each side panel having long connector tabs foldably connected to the ends thereof. At least a partial cut separates each long connector tab from the adjacent short connector tab at each corner of the blank. Such blanks may be stacked and shipped flat on pallets to a customer location. During formation on a customer's forming machine, the end panels and side panels are folded upwardly generally perpendicular to the bottom wall toward the interior surface of the carton. Each short connector tab is folded 180° to overlie the end panel to which it is foldably connected. Each long panel is then folded toward the interior side into flush engagement against the adjacent short connector tab to which it is secured by adhesive. Additional adhesive is applied between each long connector tab and the adjacent end panel at a position beyond the short connector tab. The result is a carton tray with a strong corner construction having at least a three ply wall thickness and with no exposed die-cut raw edges.

Each short connector tab may be foldably connected to the adjacent long connector tab along a fold line extending from the adjacent corner of the bottom wall and inclined generally 45° relative to the adjacent end panel end. The cut between the short and long connector tabs preferably extends from a point on the fold line spaced from the adjacent corner of the bottom wall, to an outer end of the long connector tab. That cut is preferably a straight line substantially parallel to the adjacent end panel end.

The adhesive between each long connector tab and the adjacent short connector tab and end panel is preferably arranged in at least two lines of adhesive, preferably oriented vertical and parallel to the adjacent end panel end, with one situated close to the end panel end for engaging the adjacent short connector tab and the other at a position beyond the extend of the short connector tab for securing the long connector tab to the adjacent end panel.

The short connector tab is preferably folded to overlie the interior surface of the end panel to which it is foldably connected. Adhesive is thus applied between the exterior surface of the long connector tab and the interior surface of each end panel.

Optional features for the carton include 180° foldover finish edges foldably connected to the top edge of at least some of the end panels and side panels with adhesive securing each foldover finish edge to the interior surface of the panel to which it is foldably connected. Furthermore, each of the side panels or end panels may have a pair of fold lines formed therein and extending from each adjacent corner of the bottom wall to the top edge at a generally 45° angle so that, upon folding of the die or end panels along the pair of fold lines, the side panels and end panels are laid flat against the bottom wall.

A single-piece carton may be provided with an integral lid of the general size and shape of the bottom wall with the lid having a hinged edge foldably connected to the top edge of one side panel and an opposite free edge having a down-turned closure tab foldably connected to it. Alternatively, the lid may have three sides and two glued and folded corners like the remainder of the carton.

Whereas the term "side panel" generally refers to the panel foldably connected to the long edge of a rectangular carton, the terms "side panel" and "end panel" are used interchangeably herein since it is apparent that the corner construction may be easily altered to provide the short connector tabs on either the longer or shorter of the opposed panels and the long connector tabs on the other pair of opposed panels.

DESCRIPTION OF THE PREFERRED EMBODIMENT

One embodiment of the improved carton tray 10 of the invention is illustrated in FIGS. 1–4. That tray is formed from a flat blank 12 illustrated in FIG. 2, which blank 12 has an interior surface 14 and an exterior surface 16.

Figure 9:
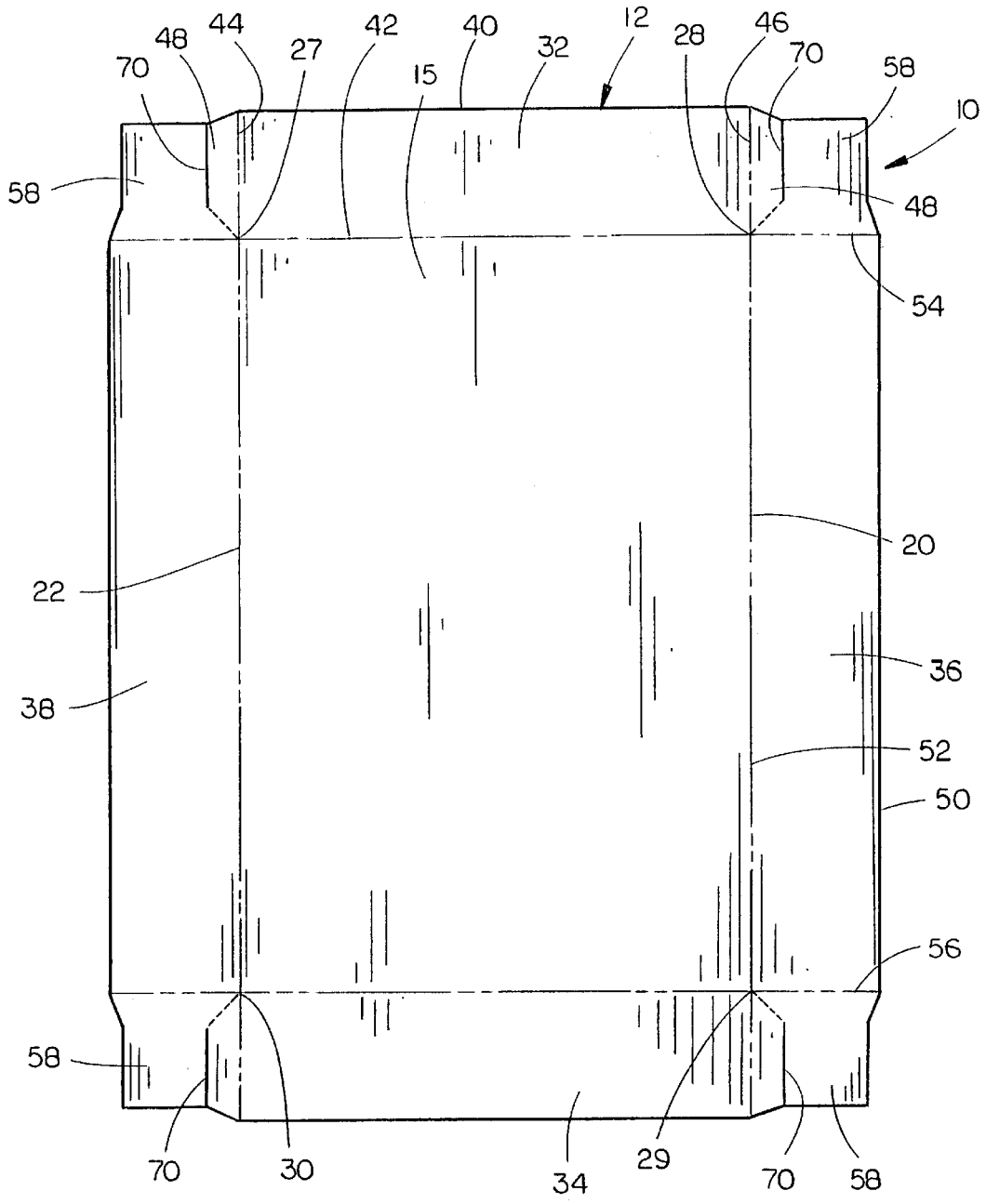
FIG. 9 is a top plan view of a blank for a basic carton tray according to the invention.

Referring to the basic carton blank of FIG. 9, the blank includes a generally rectangular bottom wall 18 having opposite side edges 20 and 22 and opposite ends 24 and 26 defining four corners 27, 28, 29 and 30.

A pair of opposite end panels 32 and 34 are foldably connected to respective opposite ends 24 and 26 of bottom wall 18. Likewise, right and left side panels 36 and 38 are foldably connected to respective opposite side edges 20 and 22 of bottom wall 18. Each end panel 32 and 24 has a top edge 40, a bottom edge 42 and opposite end panel ends 44 and 46. Short connector tab 48 is foldably connected to each respective end panel end 44 and 46. Likewise each side panel 36 and 38 has a top edge 50, a bottom edge 52 and opposite side panel ends 54 and 56 with a long connector tab 58 foldably connected to each respective side panel end 54 and 56. Each long connector tab 58 protrudes from its respective side panel end by a distance greater than the extent that each short connector tab 48 protrudes from its respective end panel end to facilitate construction of a strong corner construction at each corner of the carton as described below.

Figure 1:
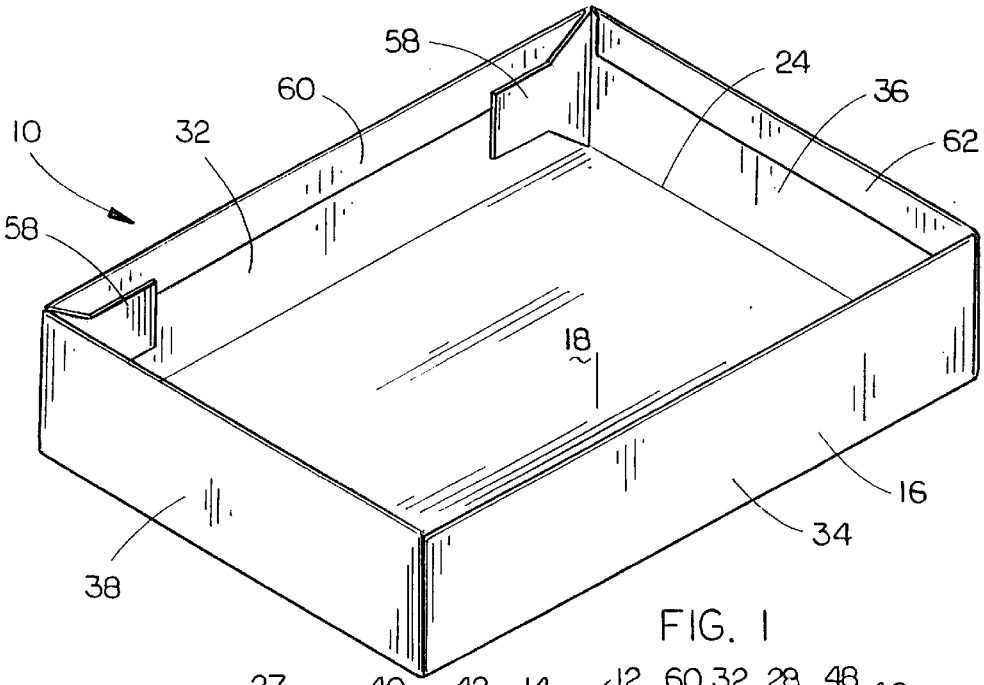
FIG. 1 is a perspective view of an assembled carton tray of the invention with 180° foldover finish edges on each side and end panel.
Figure 2:
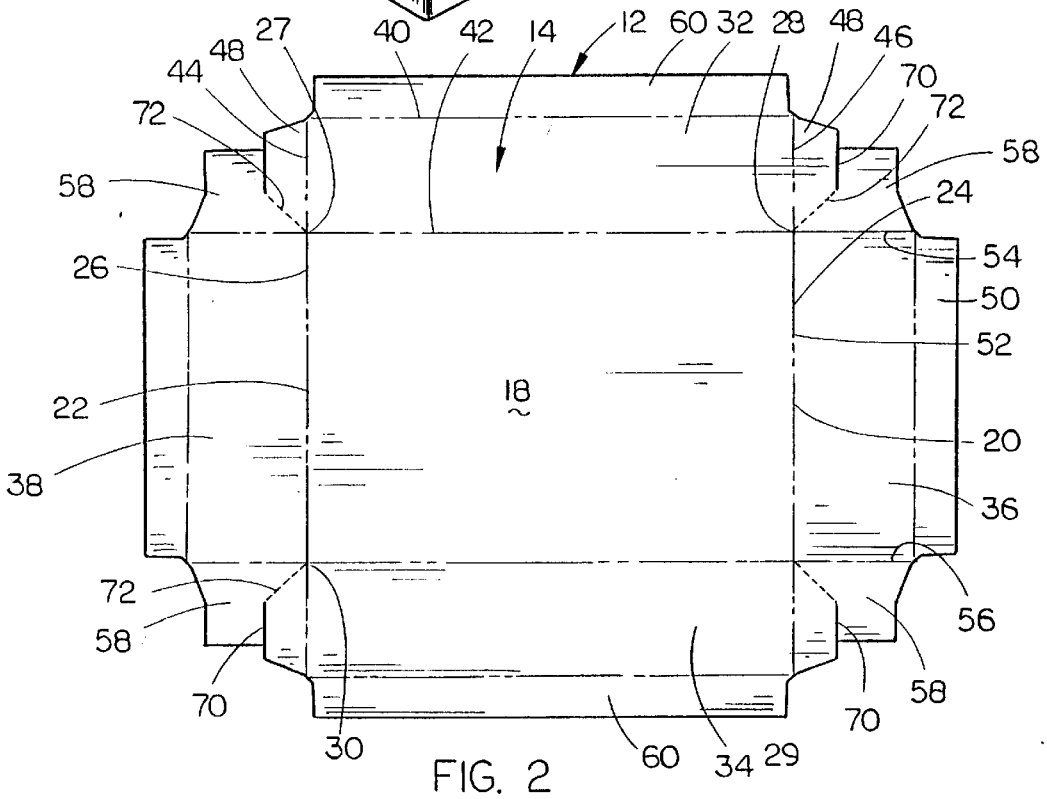
FIG. 2 is a top plan view of the flat blank for the carton tray of FIG. 1.

Whereas the short connector tab 48 are connected to the shorter end panels 32 and 34 and the long connector tabs 58 are connected to the longer side panels 36 and 38 in the embodiment of FIG. 9, it is understood that those tabs can be readily reversed as illustrated in the embodiment of FIGS. 1 and 2 so that the long connector tabs 58 are on the shorter of the end panels and side panels. Accordingly the terms "end panels" and "side panels" are used interchangeably herein and not necessarily in the conventional usage wherein the term "end panel" refers to the shorter of the wall panels and "side panels" refers to the longer of the wall panels. In this discussion, the term "end panel" simply refers to the set of opposite wall panels on which the short connector tabs are foldably connected and "side panels" simply refers to the opposite wall panels on which the long connector tabs are foldably connected.

In the embodiment of FIGS. 1 and 2, a 180° foldover finish edge 60 is provided on the top edge of each end panel 32 and 34 and a 180° foldover finish edge 62 is foldably connected to the top edge of each side panel 36 and 38. After the die cutter where the carton blank is cut, the blank is directed to a glue line where hot melt adhesive is applied to either the interior surface of each of the 180° foldover finish edges 60 and 62 or to the interior surface of the adjacent end and side panels. The 180° foldover finish edges 60 and 62 are then laid over from the dotted line positions in FIG. 3 to the solid line positions in FIG. 3 onto the respective end and side panels to which they are foldably connected. The blanks with the folded and glued foldover finish edges 60 and 62 are then stacked on pallets for shipment to a customer location where the trays will be assembled on forming machines.

Figure 4:
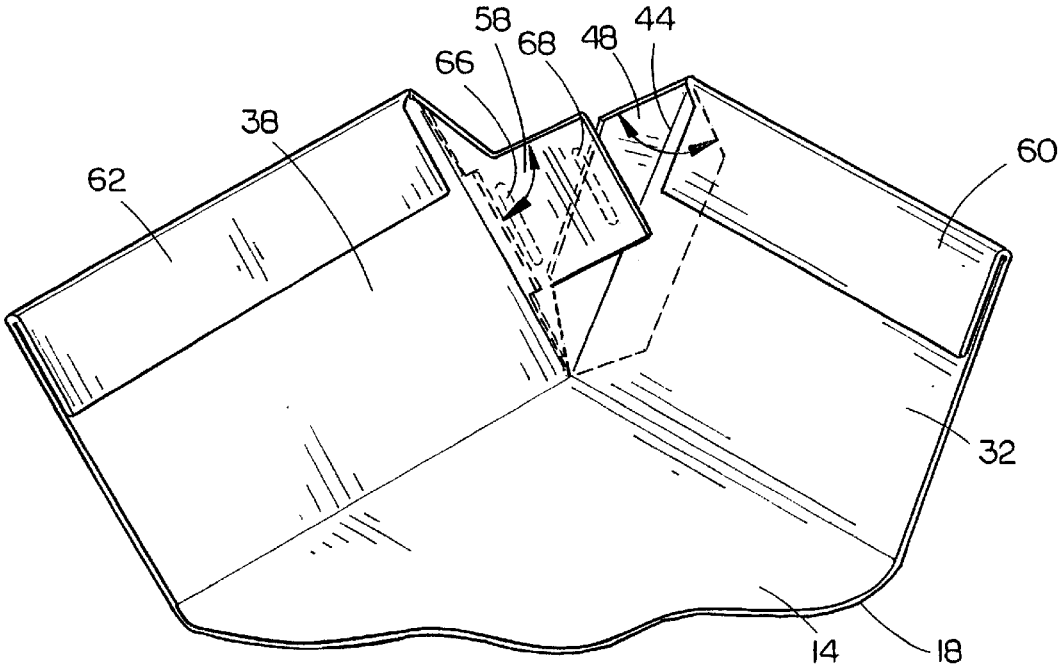
FIG. 4 is an enlarged partial detail perspective view of a partially formed corner of the carton tray of FIG. 1.

On such a forming machine, the end panels 32 and 34 and side panels 36 and 38 are inclined generally perpendicular to the bottom wall 18 toward the interior surface 14 as illustrated in FIG. 4. Each short connector tab 48 is folded 180° to overlie the end panel 32 or 34 to which it is foldably connected. Each long connector tab is then folded to be inclined generally 90° toward the interior side, as illustrated in FIG. 4, for flush engagement against the adjacent short connector tab 48.

In the embodiment illustrated in FIG. 4, two lines of adhesive 66 and 68 are applied to the exterior surface of each long connector tab 58 with one line 66 situated close to the end panel end 44 and the other line 68 situated beyond the short connector tab 48 for securing the long connector tab to the adjacent end panel 32 or 34.

The adhesive may alternately be applied to the exterior surface of short connector tab 48 and interior surface of end panel 32 and 34 after the short connector tab is folded over 180° to overlie the adjacent end panel so that both surfaces are on the same side of the blank. Regardless of the surface that receives the adhesive, it is important that adhesive be applied to only one side of the blank. This greatly simplifies the forming machinery and enables the blank to be assembled on a standard hot melt forming machine.

Whereas the short connector tabs are illustrated in FIGS. 1 and 4 as being folded over onto the interior surface of the adjacent end panel 32 or 34, they could alternately be folded onto the exterior surface of the adjacent end panel with the long connector tabs likewise then being placed exteriorly of the end panel for securement to the short connector tab and end panel. This construction is not as aesthetically pleasing from the exterior but is helpful where it is important to minimize product contact with the edges of the short and long connector tabs.

In each of the disclosed embodiments, at least a partial cut 70 separates each long connector tab from the adjacent short connector tab 48. The shape of short and long connector tabs 48 and 58 is not critical, particularly where the cut 70 is a through cut extending all the way to the adjacent corner of the bottom wall. In the preferred embodiments illustrated, however, cut 70 is only a partial cut leading from a fold line 72 extending from the adjacent corner of the bottom wall and inclined generally 45° relative to the adjacent end panel end 44 or 46. The fold line 72 between the short and long connector tabs 48 and 58 adds strength to the assembled corner and facilitates proper positioning of the tabs relative to one another in their fully folded positions as illustrated in FIG. 1.

Figure 3:
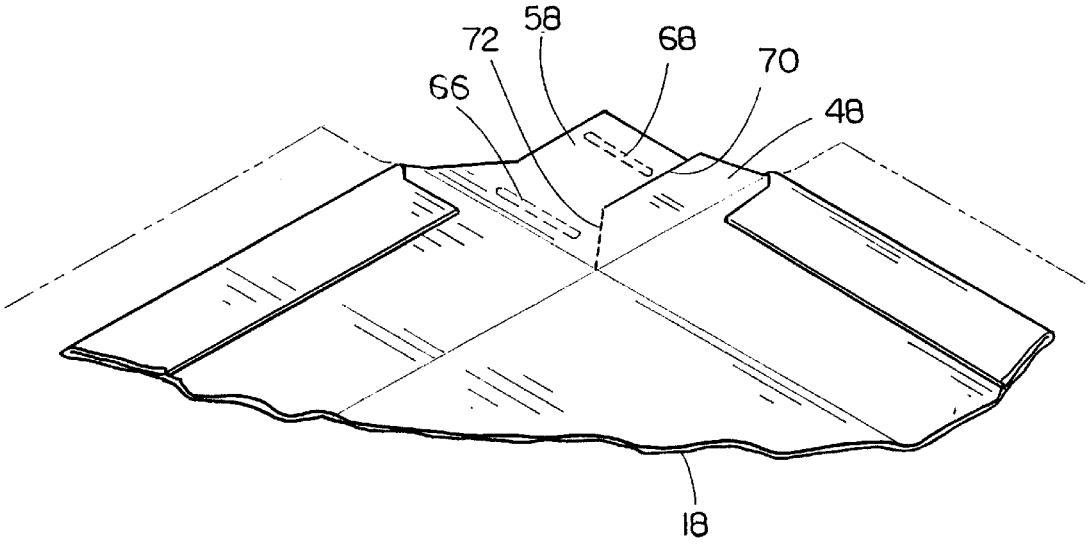
FIG. 3 is an enlarged partial detail perspective view of one corner of the blank of FIG. 2 showing the 180° foldover finish edges laid over and glued against the interior surface of the panels to which they are foldably connected.

Referring to FIG. 3, the fold line 72 extends to the outer edge of short connector tab 48, at which location cut 70 extends from a point on fold line 72 spaced from the adjacent corner of bottom wall 18 to an outer end of the long connector tab 58. Cut 70 is preferably a generally straight line substantially parallel to the adjacent panel end 44 or 46.

The resulting corner construction of the carton tray of the invention is very strong due to the multi-ply thickness of the formed corner posts and to the double adherence of each long connector tab both to the adjacent short connector tab and to the adjacent end wall. Each corner post has at least a three-ply construction including a short connector tab 48, a long connector tab 58 and an end panel 32 or 34. In those embodiments with 180° foldover finish edges 60 and 62, the corner post may take on at least a partial four-ply thickness due to that finish edge. Accordingly, the geometry and assembly of each corner post results in substantial stacking strength for the finished carton 10. These cartons are typically used in connection with a matching lid of identical construction but of approximately ⅛" greater length and width so that the base and lid telescope together. The corner post of the combined base and lid will then have at least a six-ply wall thickness for substantially increased stacking strength as compared to known carton tray constructions. A primary advantage of the strong corner construction of the carton tray 10 of the invention is that it enables the caliper of the paperboard from which the carton is formed to be reduced without sacrificing strength at the corners as compared to known corner constructions of increased caliper paperboard construction.

Figure 5:
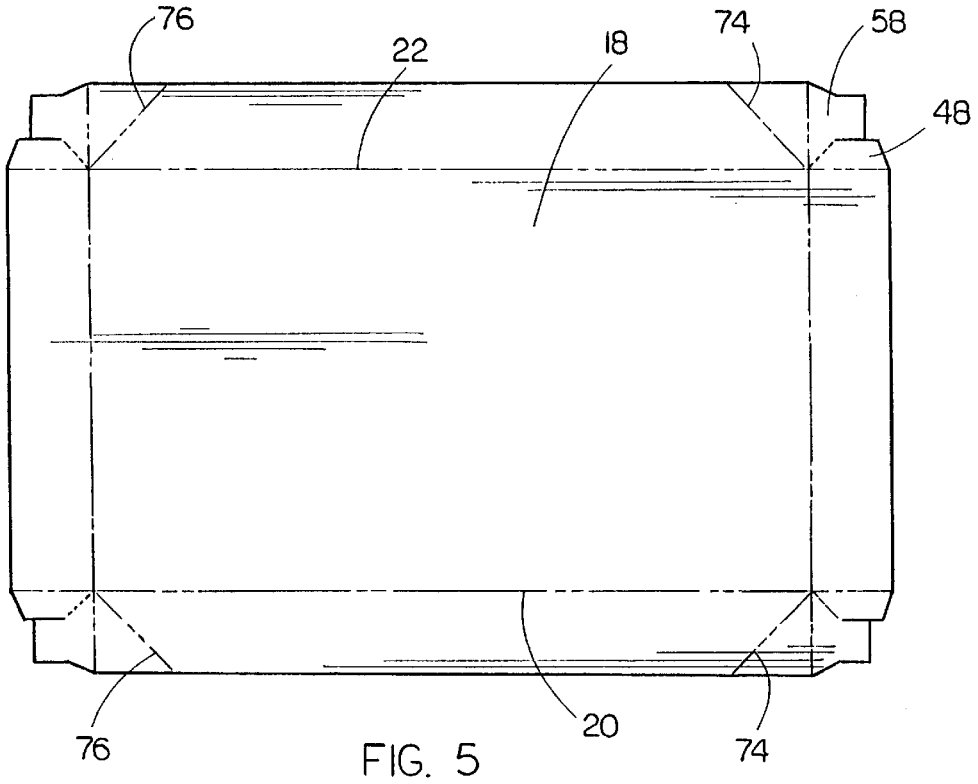
FIG. 5 is a top plan view of a basic carton blank but with a pair of fold lines formed in each side panel adjacent the ends thereof for foldably collapsing the assembled carton.
Figure 6:
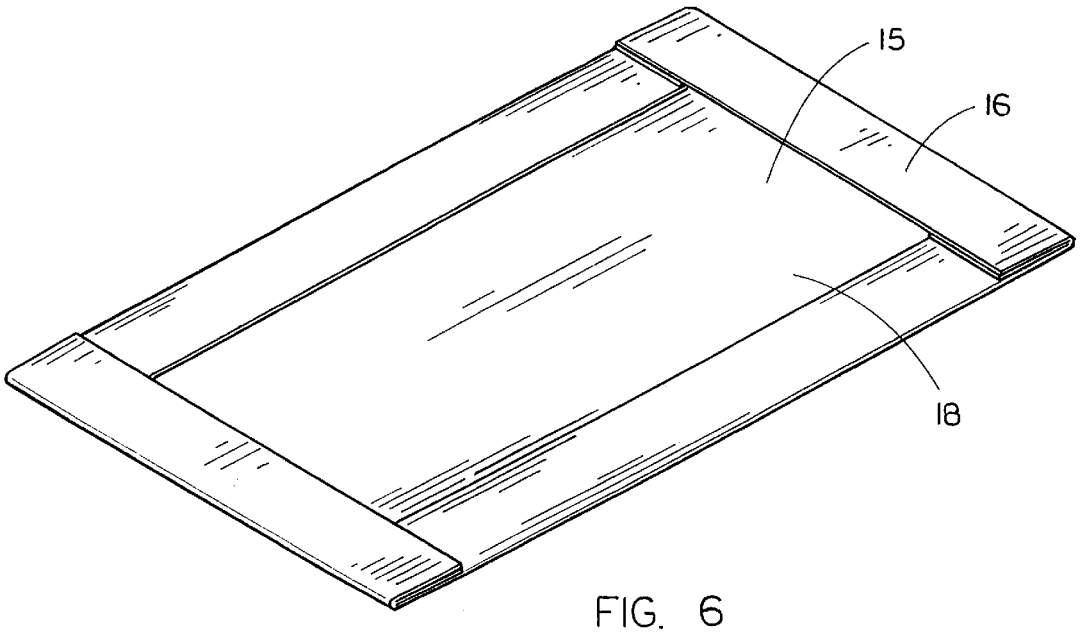
FIG. 6 shows the fully assembled carton formed from the blank of FIG. 5 in a collapsed position.

Another option for the carton tray of the invention is illustrated in FIGS. 5 and 6. Specifically, each side panel 36 and 38 has a pair of fold lines 74 and 76 formed therein and extending from each adjacent corner of the bottom wall 18 to the top edge of the side panel at a generally 45° angle whereby, upon folding of the side panels 36 and 38 along the pairs of fold lines 74 and 76, the side panels 36 and 38 and end panels 32 and 34 are laid flat against the bottom wall 18 as shown in FIG. 6. This is helpful where fully assembled carton trays are to be stacked and stored for use such as in a retail department store.

Figure 7:
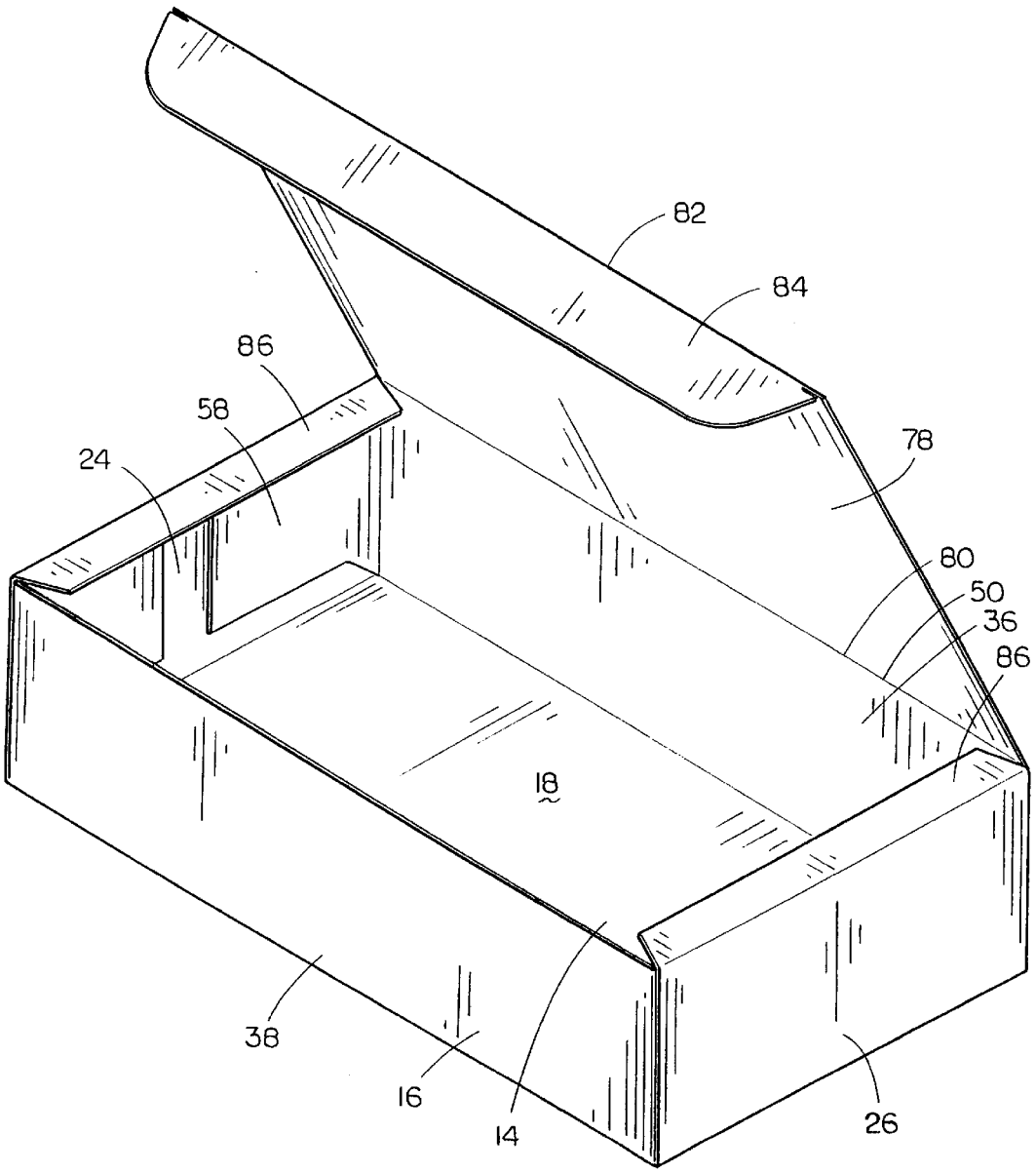
FIG. 7 is a perspective view of a carton tray according to the invention having dust flaps on the end panels thereof and an integral lid foldably connected to one side panel.
Figure 8:
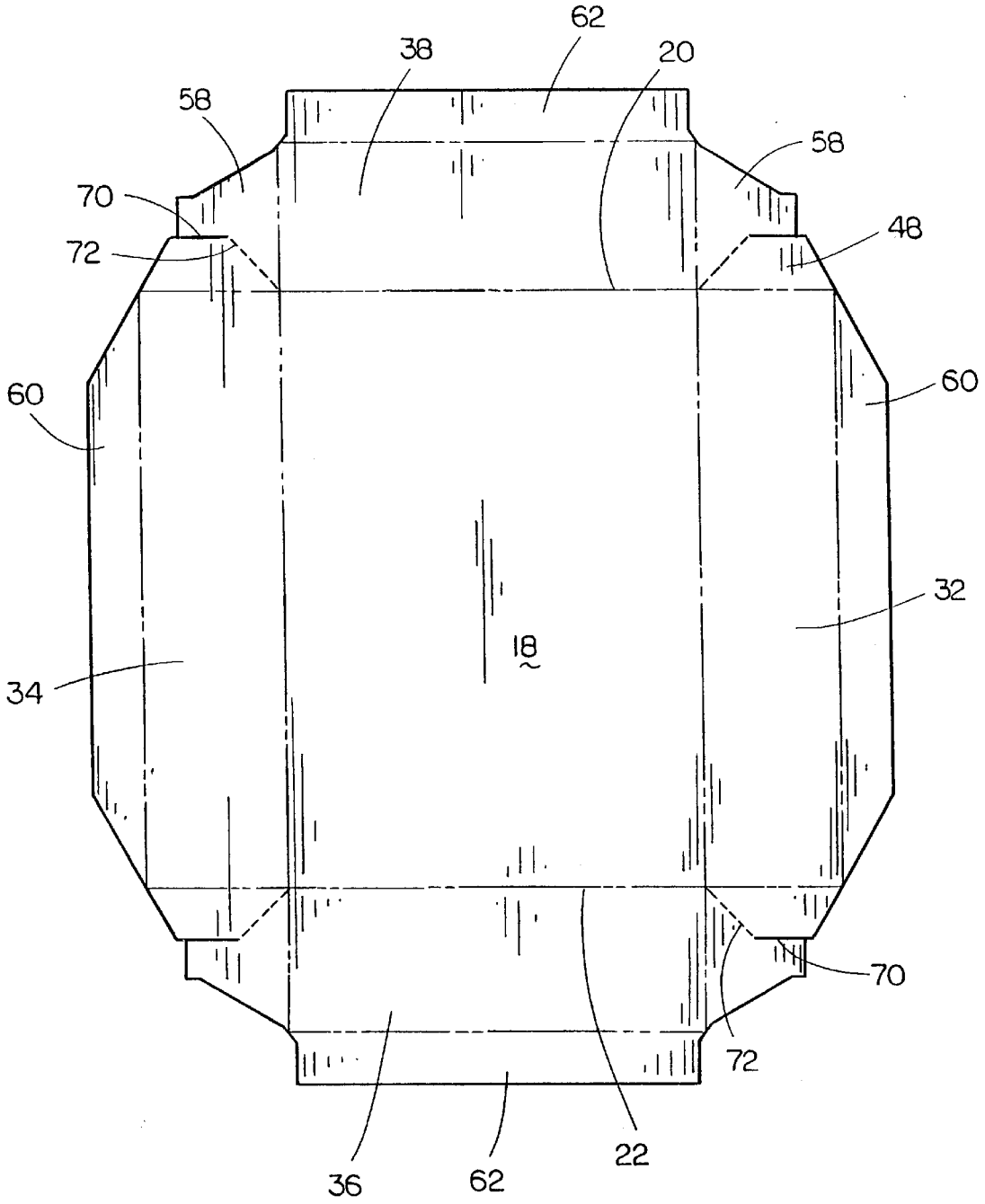
FIG. 8 is a carton tray blank similar to FIG. 2 but with a different shape for the long and short connector tabs and foldover finish edges adapted to be pre-glued by the manufacturer of the carton tray blank.

Another option for the carton tray of the invention is to provide an integral lid 78 as shown in FIG. 7. Lid 78 is of the general size and shape of bottom wall 18. It has a hinged edge 80 foldably connected to the top edge 50 of side panel 36 and an opposite free edge 82 having a downturned closure tab 84 foldably connected thereto. In the same embodiment illustrated in FIG. 7, the end panels 32 and 34 are each provided with a dust flap 86 which resembles the 180° foldover finish edge in other embodiments but which is not adhered to the interior surface of the end panel to which it is foldably connected.

Figure 10:
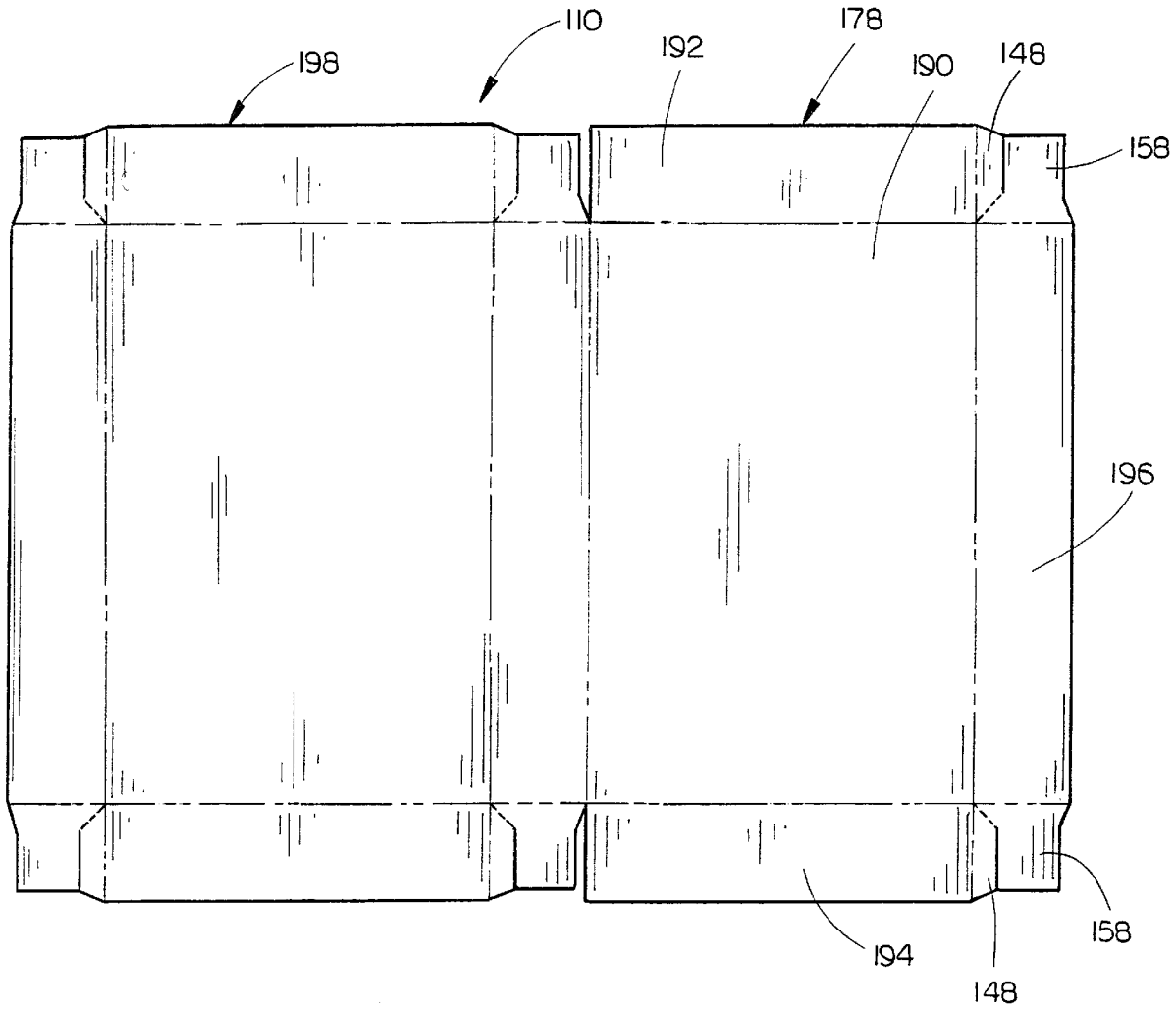
FIG. 10 a top plan view of a blank for a carton having an integral lid with three sides forming two corners like the four corners of the remaining tray portion of the carton.

FIG. 10 illustrates another carton 110 having an integral lid 178 which includes a top wall 190 having two end panels 192 and 194 and a front panel 196 foldably connected to the edtges thereof. The end panels 192, 194 each have a short connector tab 148 on the forward end, and the front panel 196 has long connector tabs 158 on its opposite ends so that lid 178, when assembled, includes two glued and folded corners like the remaining tray portion 198 of the carton 110.

The invention is further directed to a method of forming a carton tray 10 according to the invention, which method comprises providing the generally flat carton blank 12 as previously described. Adhesive 66 and 68 is applied between each long connector tab 58. The end panels 32 and 34 and side panels 36 and 38 are folded generally perpendicular to the bottom wall 18 towards the interior surface 14 and each short connector tab is folded generally 180° against the adjacent end panel. Each long connector tab is folded generally 90° toward the interior surface with adhesive 66 pressed into flush engagement against the adjacent short connector tab 48 and the adjacent end panel 32 or 34 to form at least a three-ply wall thickness at each corner.

Whereas the invention has been shown and described in connection with preferred embodiments thereof, it is understood that many modifications, additions and substitutions which are within the intended broad scope of the appended claims.

I claim:

1. A carton, comprising a carton blank having opposite interior and exterior surfaces and comprising, a generally rectangular bottom wall having opposite side edges and opposite ends and our corners, a pair of opposite end panels foldably connected to respective opposite ends of said bottom wall, right and left side panels foldably connected to respective opposite side edges of said bottom wall, each end panel having a top edge, a bottom edge and opposite end panel ends, and a pair of short connector tabs foldably connected to respective end panel ends, each side panel having a top edge, a bottom edge and opposite side panel ends and a pair of long connector tabs foldably connected to respective side panel ends, each long connector tab protruding from said respective side panel end by a distance greater than the extent that each short connector tab protrudes from said respective end panel end, a cut separating each long connector tab from the adjacent short connector tab, said end panels and side panels being inclined generally perpendicular to said bottom wall toward said interior surface, each short connector tab overlying the end panel to which it is foldably connected, each long connector tab being inclined generally 90° toward said interior side into flush engagement against the adjacent short connector tab, and adhesive between each long connector tab and the adjacent short connector tab and between each long connector tab and the adjacent end panel at a position beyond said short connector tab for securing said long connector tab to the adjacent short connector tab and to the adjacent end panel thereby forming at least a three-ply wall thickness at each corner.

2. The carton of claim 1 wherein each short connector tab is foldably connected to the adjacent long connector tab along a fold line extending from the adjacent corner of said bottom wall and inclined generally 45° relative to the adjacent end panel end.

3. The carton of claim 2 wherein said cut extends from a point on said fold line spaced from said adjacent corner to said bottom wall to an outer end of said long connector tab.

4. The carton of claim 3 wherein said cut is a generally straight line substantially parallel to said adjacent end panel end.

5. The carton of claim 1 wherein said adhesive between each long connector tab and the adjacent short connector tab and adjacent end panel is arranged in at least two lines of adhesive, one at a position for engaging the adjacent short connector tab and the other at a position for engaging the adjacent end panel.

6. The carton of claim 5 wherein said two lines of adhesive are oriented generally vertical and parallel to the adjacent end panel end.

7. The carton of claim 6 wherein said one line of adhesive is situated close to said end panel end.

8. The carton of claim 1 wherein each short connector tab overlies the interior surface of the end panel to which it is foldably connected.

9. The carton of claim 8 wherein said adhesive between each long connector tab and said end panel is between the exterior surface of said long connector tab and the interior surface of said end panel.

10. The carton of claim 9 further comprising a 180° foldover finish edge foldably connected to the top edge of at least some of said end panels and side panels and adhesive between each 180° foldover finish edge and the interior surface of the panel to which it is foldably connected.

11. The carton of claim 1 wherein each side panel has a pair of fold lines formed therein and extending from each adjacent corner of said bottom wall to said top edge at a generally 45° angle to the adjacent side panel end whereby, upon folding of said side panels along said pair of fold lines, said side panels and end panels are laid flat against said bottom wall.

12. The carton of claim 1 further comprising an integral lid of the general size and shape of the bottom wall, said lid having a hinged edge foldably connected to the top edge of one side panel and an opposite free edge having a downturned closure tab foldably connected thereto.

13. The carton of claim 1 further comprising an integral lid including a top wall slightly larger than said bottom wall and two lid end panels and a lid front panel foldably connected to edges of said top wall and including long and short connector tabs adhered together at each forward corner of the lid to form at least a three-ply wall thickness at each forward corner.

14. A method of forming a carton, comprising providing a generally flat carton blank having opposite interior and exterior surfaces and comprising, a generally rectangular bottom wall having opposite side edges and opposite ends and four corners, a pair of opposite end panels foldably connected to respective opposite ends of said bottom wall, right and left side panels foldably connected to respective opposite side edges of said bottom wall, each end panel having a top edge, a bottom edge and opposite end panel ends, and a pair of short connector tabs foldably connected to respective end panel ends, each side panel having a top edge, a bottom edge and opposite side panel ends and a pair of long connector tabs foldably connected to respective side panel ends, each long connector tab protruding from said respective side panel end by a distance greater than the extend that each short connector tab protrudes from said respective end panel end, and a cut at least partially separating each long connector tab from the adjacent short connector tab, folding said end panels and side panels generally perpendicular to said bottom wall toward said interior surface, folding each short connector tab generally 180° against said adjacent end panel, folding each long connector tab generally 90° toward said interior side into flush engagement against said adjacent short connector tab, and applying adhesive between each long connector tab and the adjacent short connector tab and between each long connector tab and the adjacent end panel at a position beyond the extend of said short connector tab thereby securing each long connector tab to the adjacent short connector tab and to the adjacent end panel and thereby forming at least a three-ply wall thickness at said corner.

15. The method of claim 14 further comprising foldably connecting each short connector tab to the adjacent long connector tab along a fold line extending from the adjacent corner of said bottom wall and inclined generally 45° relative to the adjacent end panel end.

16. The method of claim 15 further comprising forming said cut between each long connector tab and the adjacent short connector tab to extend from a point on said fold line spaced from said adjacent corner of said bottom wall to an outer end of said long connector tab.

17. The method of claim 16 wherein forming said cut further comprises forming said cut as a straight line substantially parallel to said adjacent end panel end.

18. The method of claim 14 wherein the step of applying adhesive further comprises applying two lines of adhesive to each long connector tab, one at a position for engaging the adjacent short connector tab and the other at a position for engaging the adjacent end panel.

19. The method of claim 18 wherein the step of applying adhesive comprises applying adhesive to the exterior surface of each long connector tab.

20. The method of claim 19 wherein the step of applying adhesive further comprises orienting said two lines of adhesive generally vertical and parallel to the adjacent end panel end.

21. The method of claim 20 wherein the step of applying adhesive further comprises situating said one line of adhesive close to said end panel end.

* * * * *